US005890380A

United States Patent [19]

Ives et al.

[11] Patent Number: 5,890,380

[45] Date of Patent: Apr. 6, 1999

[54] ELASTIC KNITTED BAND HAVING STRETCH WOVEN BAND FEEL AND APPEARANCE AND METHOD OF MAKING SAME

[75] Inventors: Robert K. Ives; Vincent K. Snow, both of Quitman, Ga.

[73] Assignee: Beech Island Knitting Company, Inc., Quitman, Ga.

[21] Appl. No.: 897,014

[22] Filed: Jul. 18, 1997

[51] Int. Cl.[6] ..... D04B 1/00

[52] U.S. Cl. ..... 66/170; 66/192; 66/195

[58] Field of Search ..... 66/169 R, 170, 66/190, 191, 192, 193, 195, 196, 202, 203; 442/306, 305, 312, 313, 314

[56] References Cited

U.S. PATENT DOCUMENTS

| | | | |
|---|---|---|---|
| 4,003,224 | 1/1977 | Odham | 66/193 |
| 4,215,684 | 8/1980 | Westip | 66/193 |
| 4,248,064 | 2/1981 | Odham | 66/192 |
| 4,477,928 | 10/1984 | Graff | 2/221 |
| 4,688,403 | 8/1987 | Gajjar | 66/195 |
| 4,784,219 | 11/1988 | Sato et al. | 66/190 |
| 4,818,316 | 4/1989 | Weinle et al. | 66/193 |
| 5,375,266 | 12/1994 | Crisco | 2/243.1 |
| 5,400,729 | 3/1995 | Bryant | 112/121.26 |
| 5,452,591 | 9/1995 | King | 66/83 |
| 5,522,240 | 6/1996 | Wall et al. | 66/192 |
| 5,632,528 | 5/1997 | Mclarty, III et al. | 66/192 |

*Primary Examiner*—Jeanette Chapman
*Assistant Examiner*—Larry D. Worrell, Jr.
*Attorney, Agent, or Firm*—Jenkins & Wilson, P.A.

[57] ABSTRACT

An elastic knitted band having stretch woven appearance and feel including filling yarn laid in between the warp yarn needles. The filling yarns are secured to the elastic band by the conventional warp yarn chain stitches so as to become an integral component of the elastic knit band without creating warp or filling ridges. The filling yarns can be positioned: (1) in front of the back weft yarns; (2) behind the front weft yarns; or (3) in between front and back elastomer bars separating the elastomer threads. The filling yarn preferably is textured yarn.

16 Claims, 14 Drawing Sheets

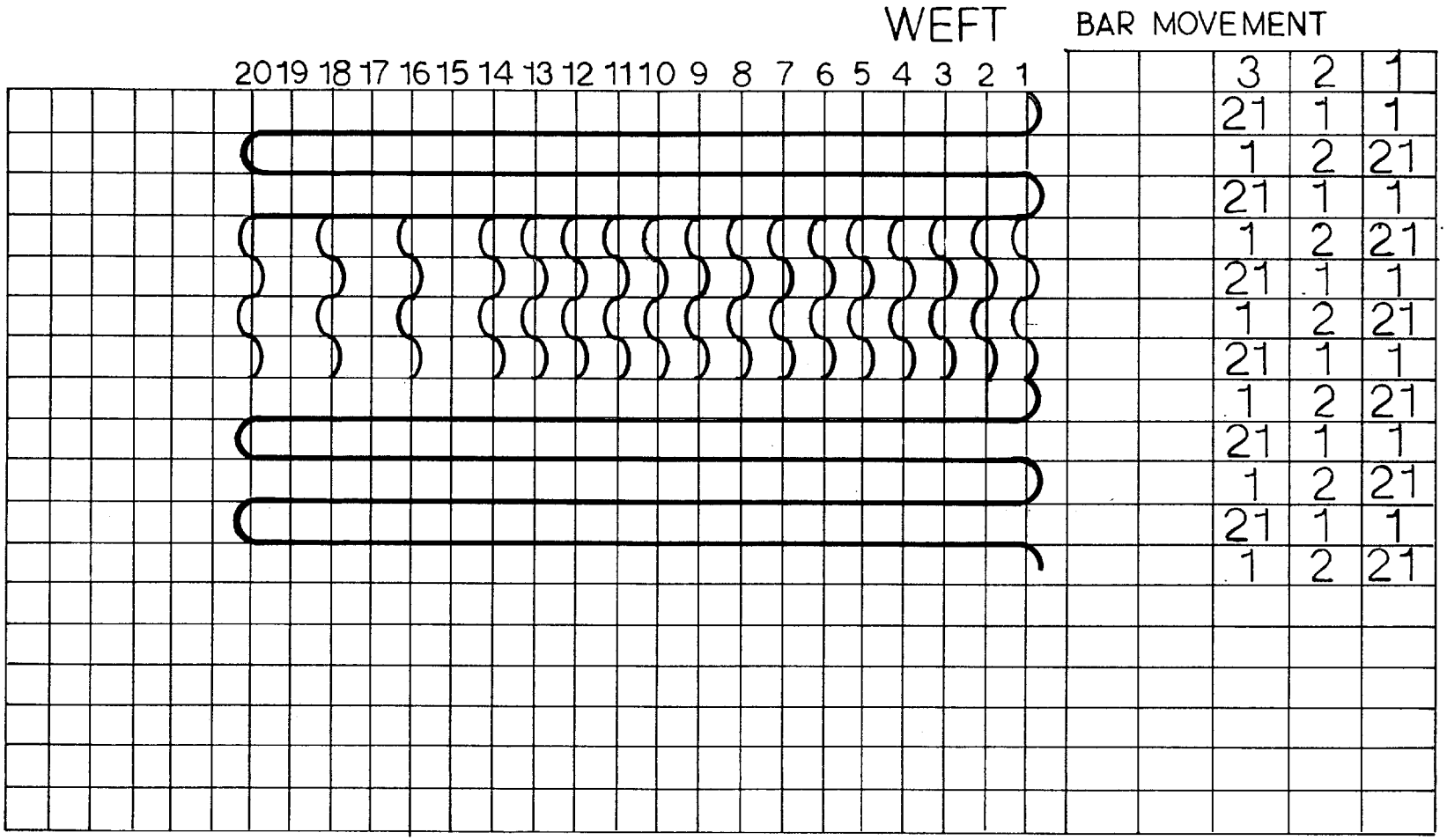
(PRIOR ART) FIG. 6

(PRIOR ART) FIG. 8

(PRIOR ART) FIG. 9

ELASTIC KNITTED BAND HAVING STRETCH WOVEN BAND FEEL AND APPEARANCE AND METHOD OF MAKING SAME

TECHNICAL FIELD

The present invention relates generally to knitted elastic bands for use in the fabrication of textile garments such as men's underwear, women's lingerie and the like. More particularly, the present invention relates to an improved elastic knit band possessing hand and appearance similar to stretch woven bands.

RELATED ART

An assortment of apparel clothing such as men's underwear and women's lingerie utilize a knitted elastic waistband for comfort and to maintain the garment in place on the user's body. Although the knitted elastic bands are relatively inexpensive to manufacture, the conventional knitted elastic bands suffer well-known shortcomings including an "inexpensive" appearance and feel to the hand. Thus, it is also well-known in the garment field to utilize stretch woven bands for men's underwear, women's lingerie and the like in order to obtain a more expensive appearance and feel. The woven stretch bands provide a heavier hand and thicker appearance, but the stretch woven bands are typically only utilized in better apparel garments due to their high cost relative to knitted elastic bands. Thus, there has been a long-felt need for a relatively inexpensive knitted elastic band that would provide the appearance and feel of a more expensive stretch woven band in garments. Applicants are aware of many efforts to accomplish this end, but none of these efforts to date have been commercially successful.

For example, it has been attempted to utilize a high denier textured filling yarn in the warp in order to provide improved appearance and hand to a knitted elastic band, but the filling yarn has difficulty fitting onto the warp needles and the finished construction possesses lengthwise ridges that are highly undesirable in appearance. Further, it has been attempted to add a high denier textured filling yarn as a weft yarn in a knitted elastic band but the efforts have been unsuccessful since the finished knitted elastic bands possess rope-like bands in the weft direction so as to also render it undesirable from a cosmetic perspective for use in men's underwear, women's lingerie and the like.

Applicants have discovered an improved knitted elastic band product and its method of manufacture which does not possess the shortcomings of prior art constructions that were intended to simulate the excellent hand and appearance characteristics of woven stretch bands. Therefore, applicants have discovered a knitted elastic band and its method of manufacture that simulates the appearance and hand of a woven stretch band and that is lower in cost to produce.

DISCLOSURE OF THE INVENTION

In accordance with the present invention, applicant provides an elastic knit band for apparel and the like characterized by appearance and hand similar to that of a stretch woven band. The elastic knit band comprises an elastic knit band constructed on a flat bed warp knitting machine with weft insertion wherein the warp yarn is provided by a warp guide bar to bearded needles positioned in a needle bed. The knit elastic band is further formed by five weft insertion bars each carrying a plurality of yarn guides comprising in sequence a back weft yarn bar, a back elastomer thread bar, a filling yarn bar, a front elastomer thread bar, and a front weft yarn bar. The elastic band is knitted by laying the filling yarn (e.g., textured yarn, spun synthetic yarn, spun natural fiber yarn, etc.) in between the warp knitting needles during the knitting process such that the finished knitted elastic band includes the filling yarn positioned in the band between the front and back elastomer threads for enhanced cover and feel characteristics similar to a stretch woven band.

The elastic knit band of the present invention is made by providing a flat knitting weft insertion machine of the type having an elongate needle bed for carrying and initially reciprocating a plurality of warp yarn knitting needles and a warp guide bar for carrying a corresponding plurality of warp yarn guides. Most preferably, five weft insertion bars are provided wherein each bar carries a plurality of yarn guides and the five weft insertion bars comprise in sequence a back weft yarn bar, a back elastomer thread bar, a filling yarn, a front elastomer thread bar, and a front weft yarn bar. The yarns are knitted into an elastic band by laying the filling yarn in between the warp knitting needles during the knitting process such that the filling yarn is positioned in the completed knitted band between the front and back elastomer threads for enhanced appearance and feel.

Thus, it is an object of the present invention to provide a knitted elastic band possessing enhanced appearance and feel similar to that of a woven stretch band.

It is another object of the present invention to provide a knitted elastic band similar in appearance and feel to a stretch woven band but significantly more economical to make.

It is another object of the present invention to provide a knitted elastic band by laying in textured filling yarn between the warp needles so as to provide similar appearance and feel to a stretch woven band when used in apparel goods such as men's jockey underwear, women's lingerie and the like.

Other objects and advantages of the present invention will become apparent and obvious from a study of the following descriptions and the accompanying drawings which are merely illustrative of such invention.

BRIEF DESCRIPTION OF THE DRAWINGS

FIG. 6 is a technical drawing of the construction of a conventional knitted elastic band as fabricated on the apparatus shown in FIG. 2;

DETAILED DESCRIPTION OF THE INVENTION

Figure 1A:
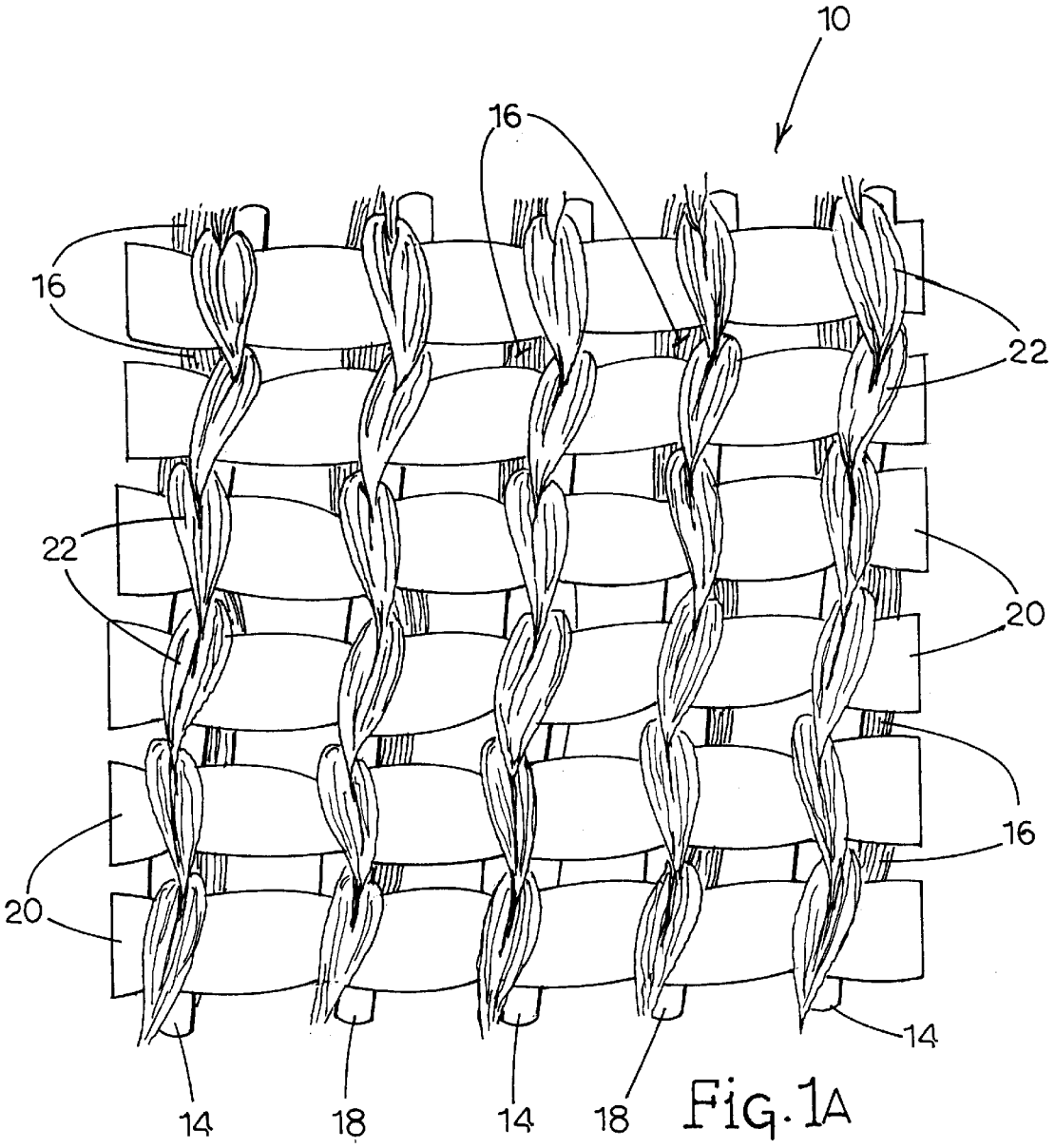
FIGS. 1A and 1B are schematic drawings of the front and back faces, respectively, of one embodiment of the elastic knit band of the invention.
Figure 1B:
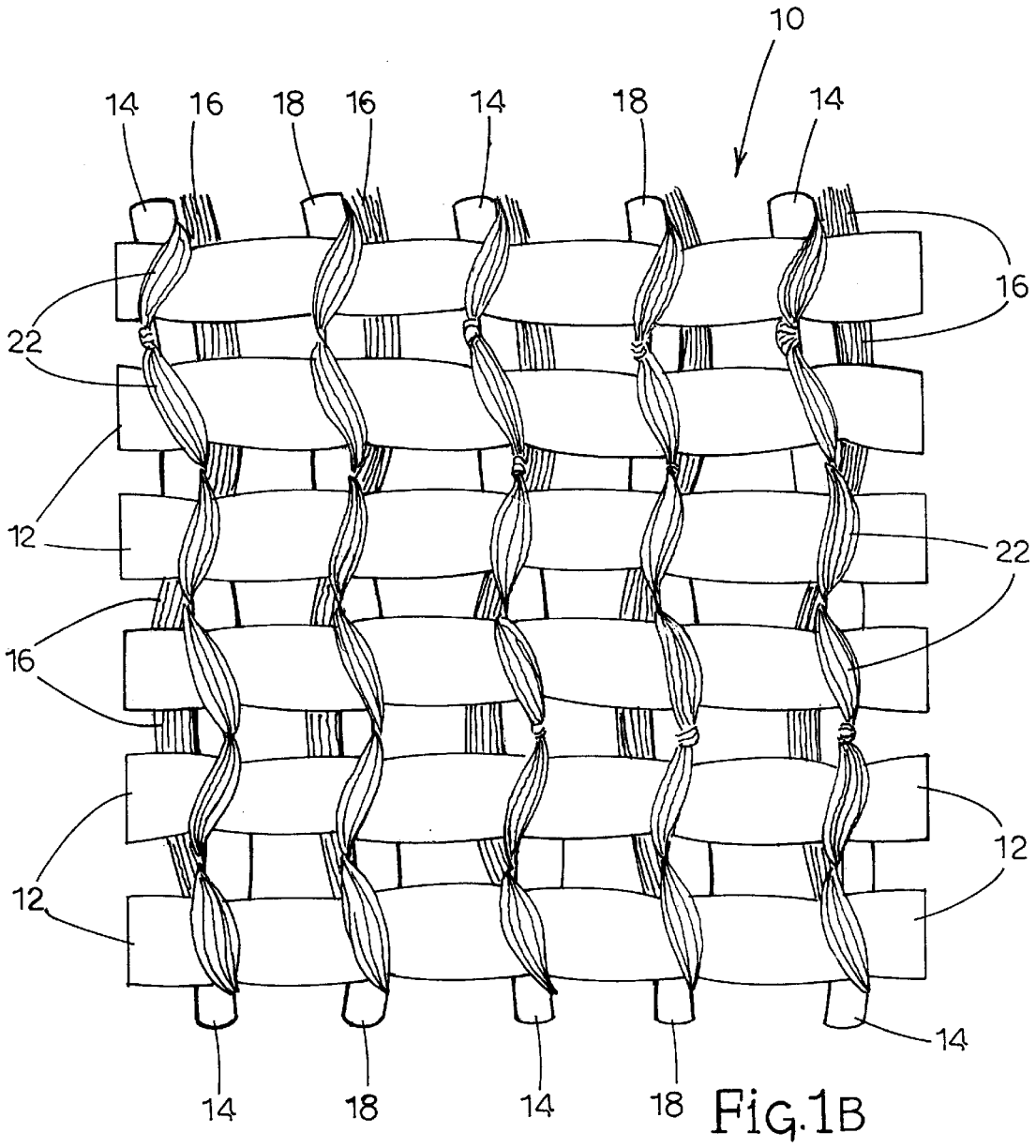
Figure 3:
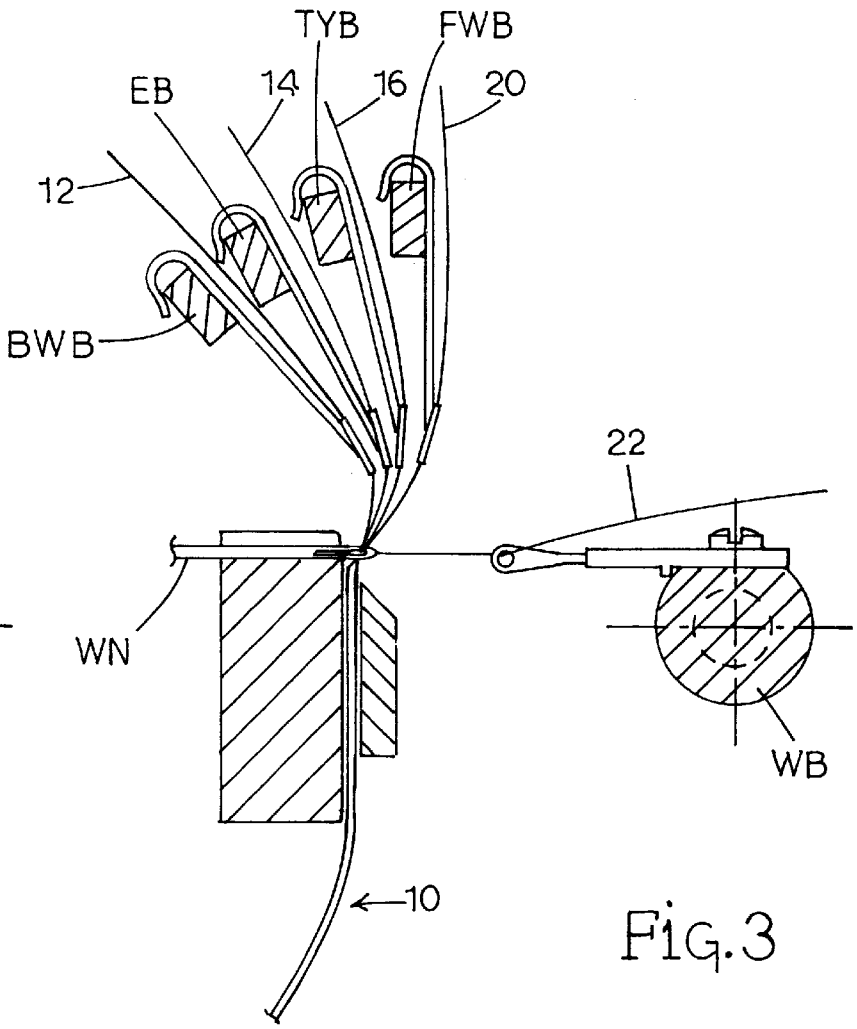
FIG. 3 is a schematic vertical cross-sectional view of a conventional warp insertion knitting machine of FIG. 1 as modified and embodied in accordance with a first embodiment of the present invention.

Referring now to the drawings, the knitted elastic band of the present invention is shown therein and indicated generally by the numeral 10 (see particularly the embodiment shown in FIG. 1). Knitted elastic band 10 generally comprises a back weft yarn 12, a back elastomer thread 14, a filling yarn 16 (preferably textured yarn), a front elastomer thread 18, and a front weft yarn 20 that are knitted together with conventional warp yarn 22 chain stitches. Elastic knit band 10 can be formed on substantially any weft insertion flat bed warp knitting machine that can be set up with five or more weft insertion bars. The additional weft insertion bars required by the instant invention are easy to install on a flat bed, weft insertion warp knitting machine and can be easily added by one skilled in the art of flat bed warp knitting. As would be known to one skilled in the art, traditional knit elastic band construction would typically require only three weft insertion bars (see FIG. 2) whereas applicants' invention requires either four or five weft insertion bars depending on the particular preferred embodiment of the inventive elastic knit band being manufactured (see FIGS. 3–5).

While elastic knit band 10 of the invention in its ultimate simplicity provides laying in extra ends of filling yarn 16 (preferably textured yarn) between the warp needles so that the finished knitted band is provided with more cover to prevent "seeing through" the stretch band as well as an improved hand more similar to a stretch woven band, applicants contemplate that the knitted band can be made in several different ways in order to capture the filling yarn 16 with the conventional warp yarn chain stitches so as to stitch filling yarn 16 into the fabric to provide the appearance and feel of a stretch woven band.

Thus, three preferred embodiments of applicants' invention will be described in detail below although applicants do not intend to limit the invention solely to the three embodiments described herein but intend that the three embodiments are to be considered in all respects as illustrative and not restrictive, and all changes coming within the meaning and equivalency range of the claims are intended to be embraced by the claims.

Figure 2:
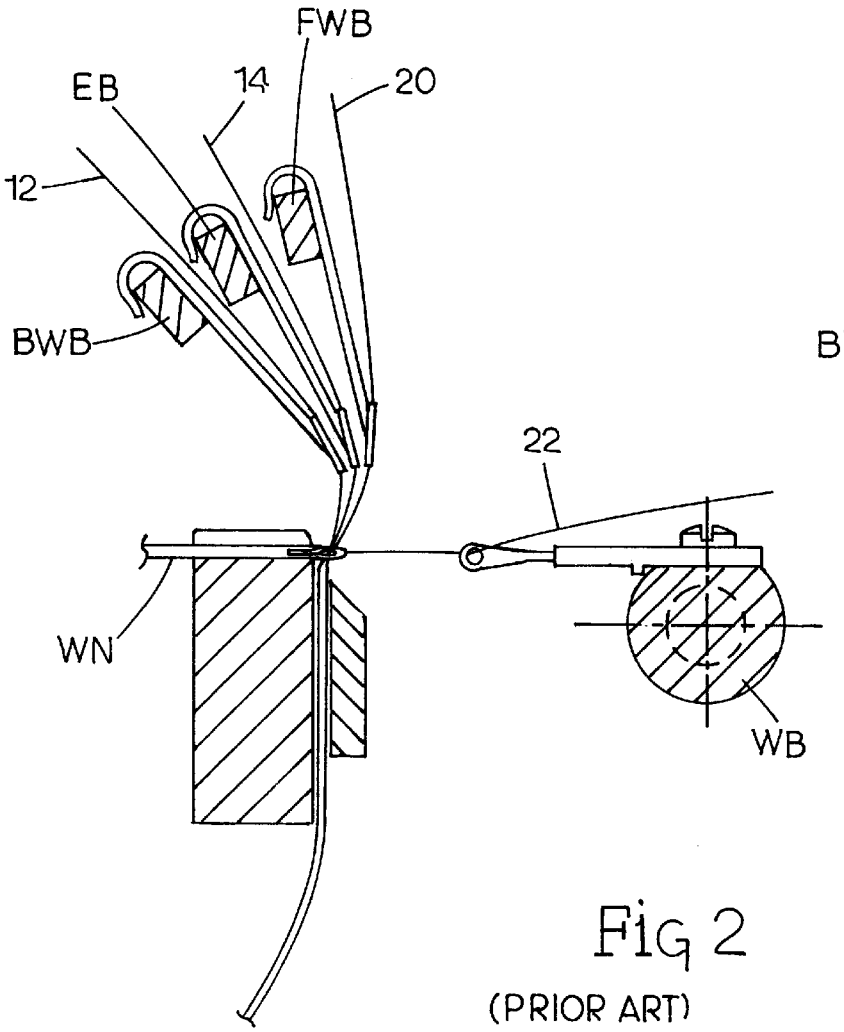
FIG 2 (PRIOR ART)
FIG. 2 is a schematic vertical cross-sectional view of a conventional warp insertion machine for fabricating a conventional elastic band.

To better appreciate applicants' elastic knit band 10, reference is now made to FIG. 2 disclosing the warp knitting machine set-up to knit a conventional prior art knitted elastic band. The warp knitting machine can be seen to include conventional warp yarn bar WB, a back weft yarn bar BWB, an elastomer thread bar EB, and a front weft yarn bar FWB. The knitted elastic band produced by this conventional machine set-up is inexpensive and easy to produce, but does not provide the cover and feel of a higher quality stretch woven band.

Applicants' novel knitted elastic band 10 can be formed in at least three constructions wherein filling yarn 16 is laid in between the warp needles WN so as to provide enhanced cover and hand to knitted elastic band 10 that is comparable to that of a high quality stretch woven band. In the first embodiment shown in FIG. 3, the novel knitted elastic band is formed with a conventional warp yarn bar WB and four weft insertion bars consisting of a back weft yarn bar BWB, an elastomer thread bar EB, a filling yarn bar TYB, and a front weft yarn bar FWB. In this construction, the filling yarn is laid into the warp ends and is knitted into the finished band so as to be knitted into the front of the band and behind front weft yarns 20. The warp yarns 22 form conventional parallel and spaced-apart vertically extending chain stitches that lock filling yarn 16 into the knitted elastic band so that it becomes a part of the structure thereof.

Figure 4:
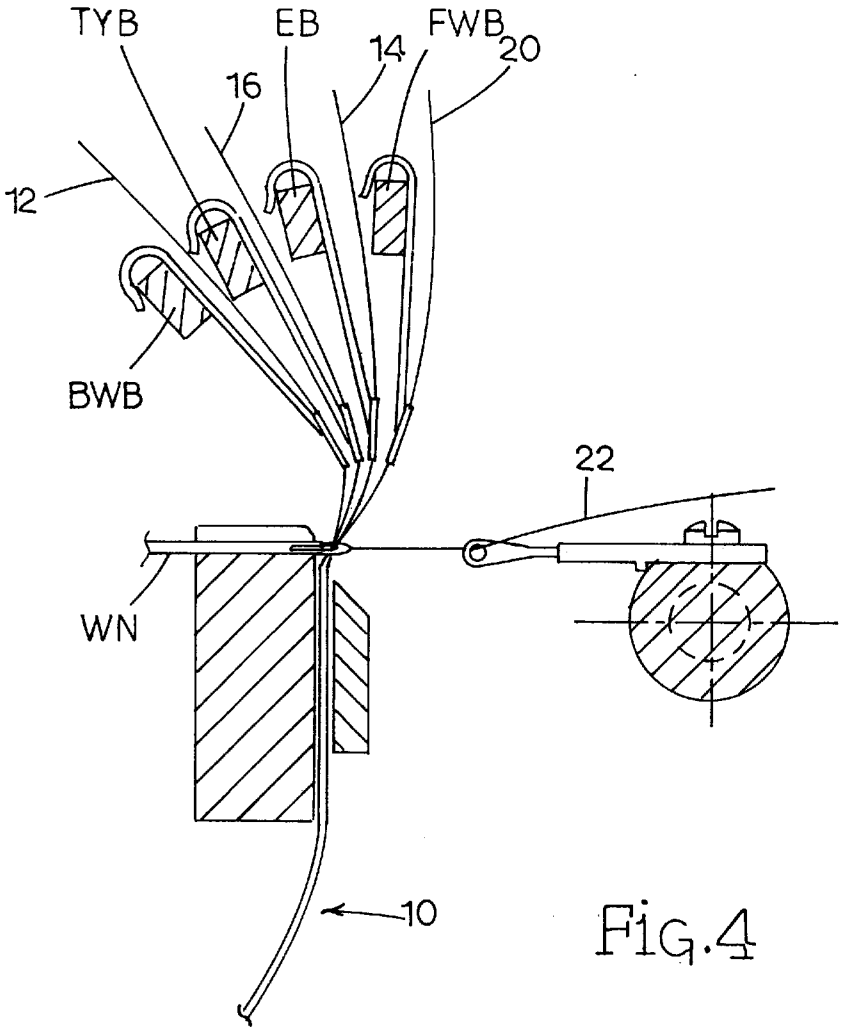
FIG. 4 is a schematic vertical cross-sectional view of a second conventional warp insertion knitting machine as modified in accordance with a second embodiment of the present invention.
Figure 7:
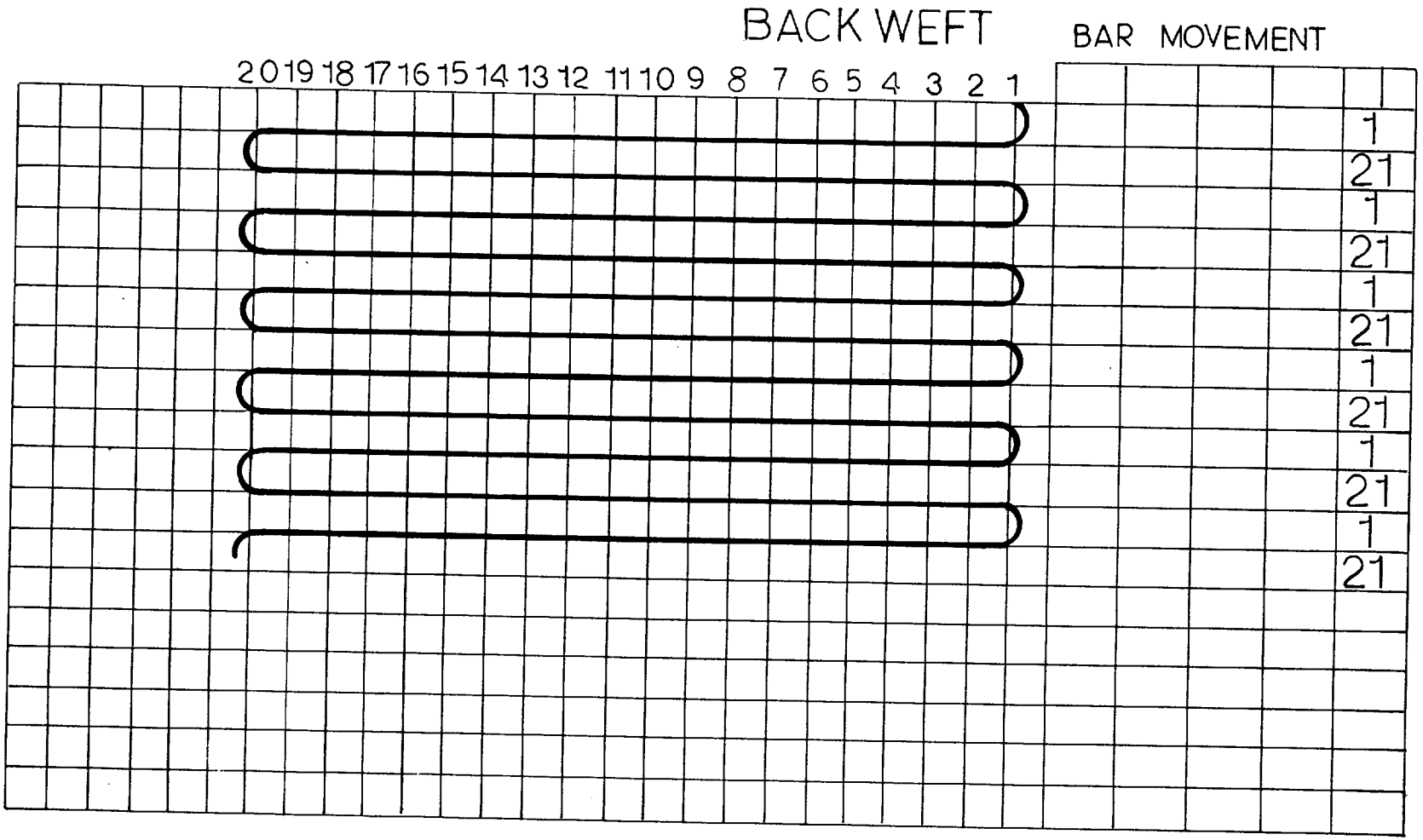
FIG. 7 (PRIOR ART)
FIG. 7 is a technical drawing showing the back weft yarn of the conventional knitted elastic band shown in FIG. 6.
Figure 8:
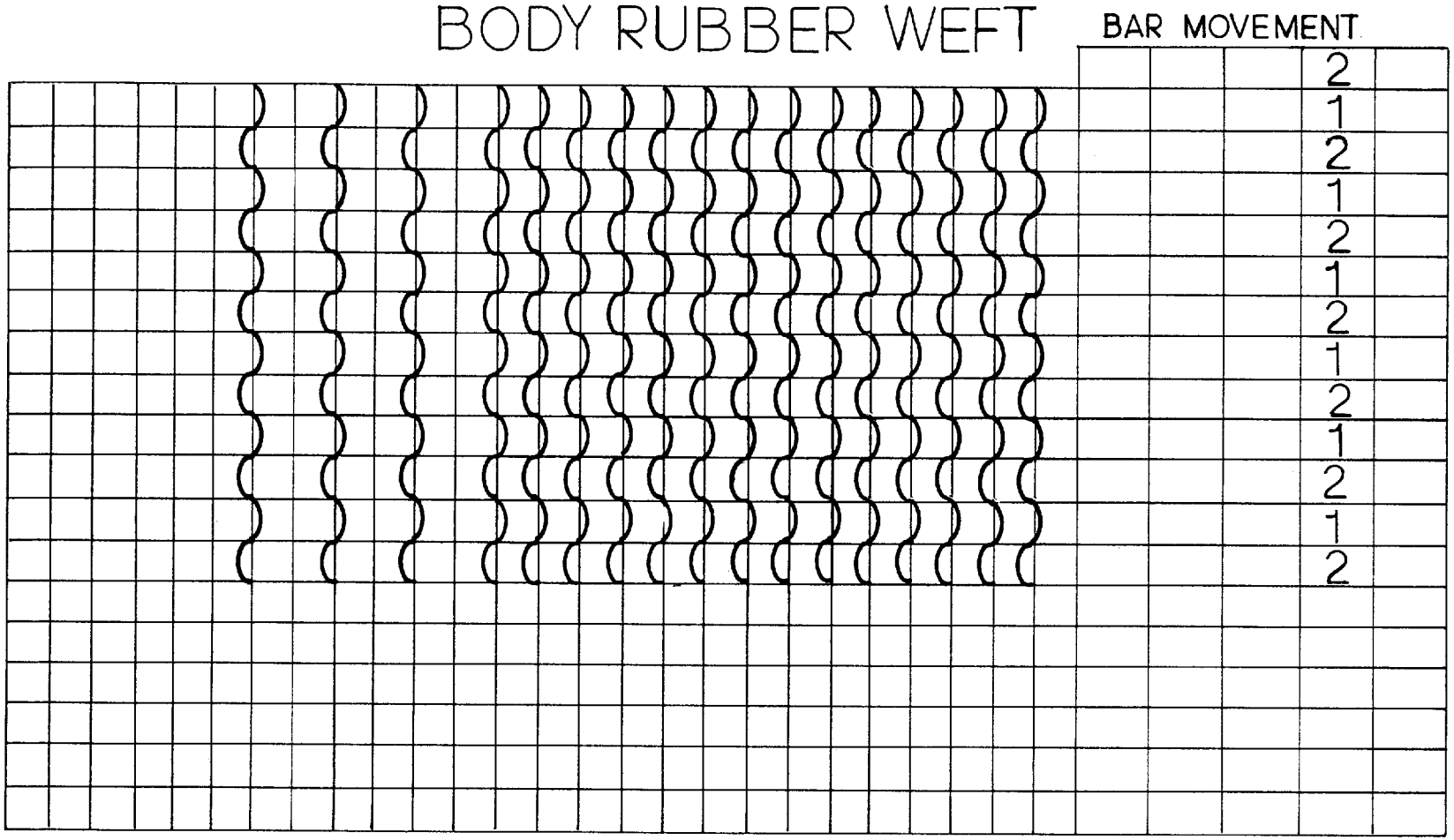
FIG. 8 is a technical drawing showing the elastomer thread of the conventional knitted elastic band shown in FIG. 6.

A second embodiment of the present invention is shown in FIG. 4 wherein the novel knitted elastic band is formed from back weft yarn bar BWB, filling yarn bar TYB, elastomer thread bar EB, front weft yarn bar FWB, and conventional warp yarn bar WB. In this construction which is similar to the construction of FIG. 3, filling yarn 16 is knitted into the elastic band so as to be positioned immediately behind back weft yarn 12 when looking at the back of the fabric.

Figure 5:
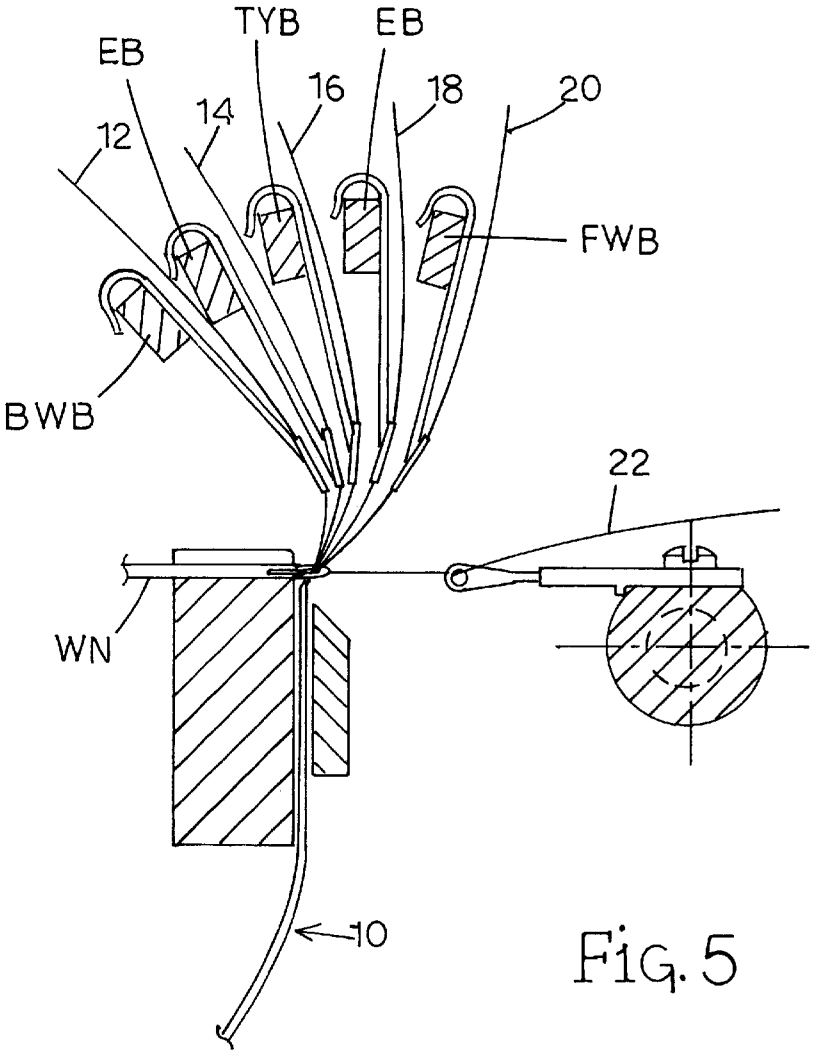
FIG. 5 is a schematic vertical cross-sectional view of a conventional weft insertion knitting machine as modified in accordance with a third (and perhaps most preferred) embodiment of the present invention.

And perhaps the most advantageous embodiment of applicants' inventive knitted elastic band is fabricated on the machine set-up seen in FIG. 5. The knitted elastic band (see FIG. 1) is formed with (in sequence) back weft yarn 12, elastomer thread 14, filling yarn 16, front elastomer thread 18, front weft yarn 20, and the chain stitched warp yarns 22 provided by five corresponding weft bars and the conventional warp yarn bar. Technical machine set-up drawings are shown in FIGS. 10–15 that illustrate how the five yarn systems are inserted by the five weft bars assuming conventional warp yarn chain stitching (see FIG. 10), the set-up of back weft yarn 12 alone (see FIG. 11), the set-up of back elastomer thread 14 alone (see FIG. 12), the set-up of filling yarn 16 alone (see FIG. 13), the set-up of front elastomer thread 18 alone (see FIG. 14), and the set-up of front weft yarn 20 alone (see FIG. 15), respectively.

Figure 9:
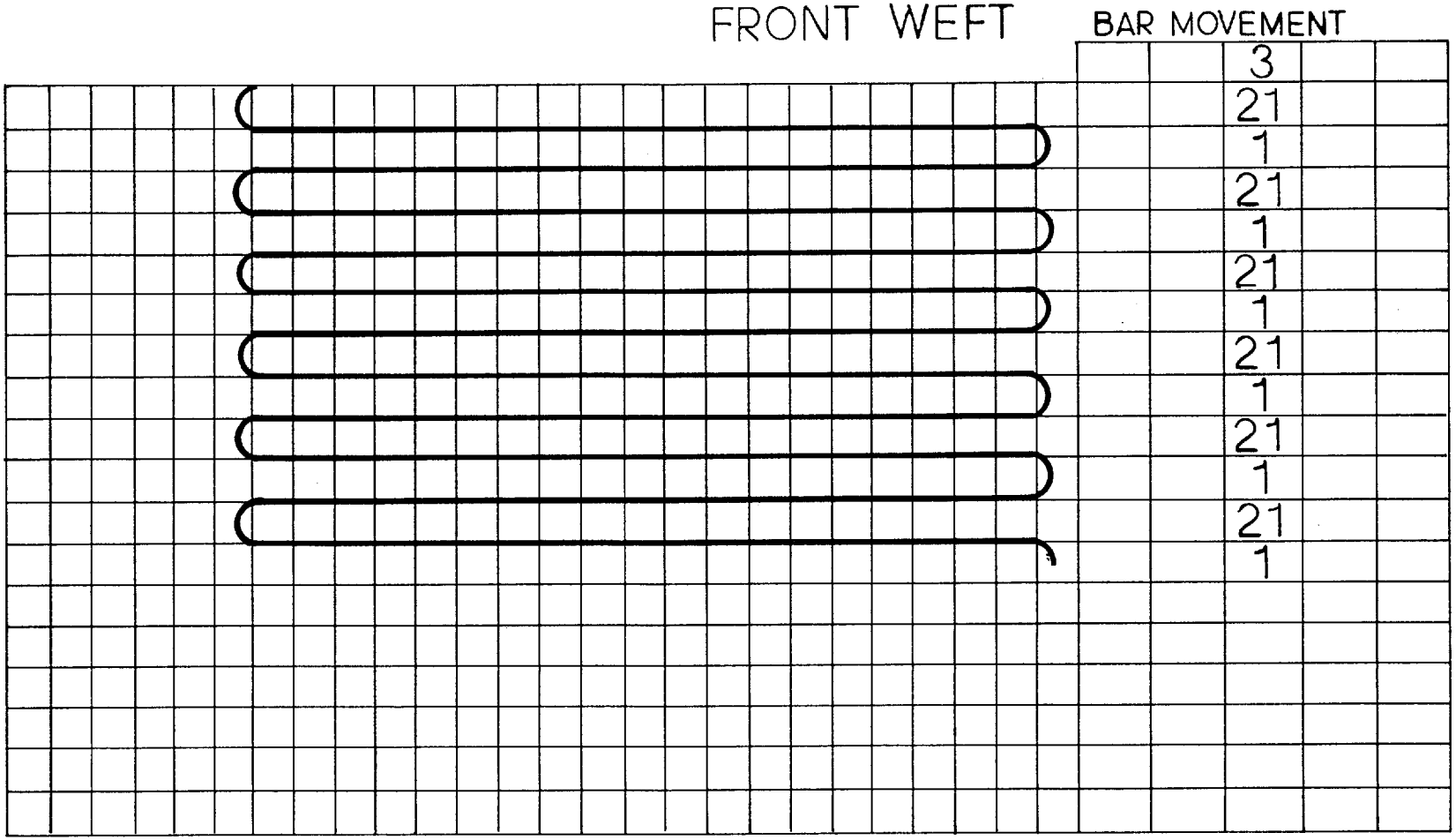
FIG. 9 is a technical drawing showing the front weft yarn of the conventional knitted elastic band shown in FIG. 6.

Corresponding drawings are shown in FIGS. 6–9 that illustrate the machine set-up for knitting a prior art elastic band (see FIG. 6), the set-up for back weft yarn 12 alone (see FIG. 7), the set-up for elastomer thread 18 alone (see FIG. 8), and the set-up for front weft yarn 20 alone (see FIG. 9). A schematic drawing of the weft insertion warp knitting machine to make the prior art band is shown in FIG. 2.

Figure 10:
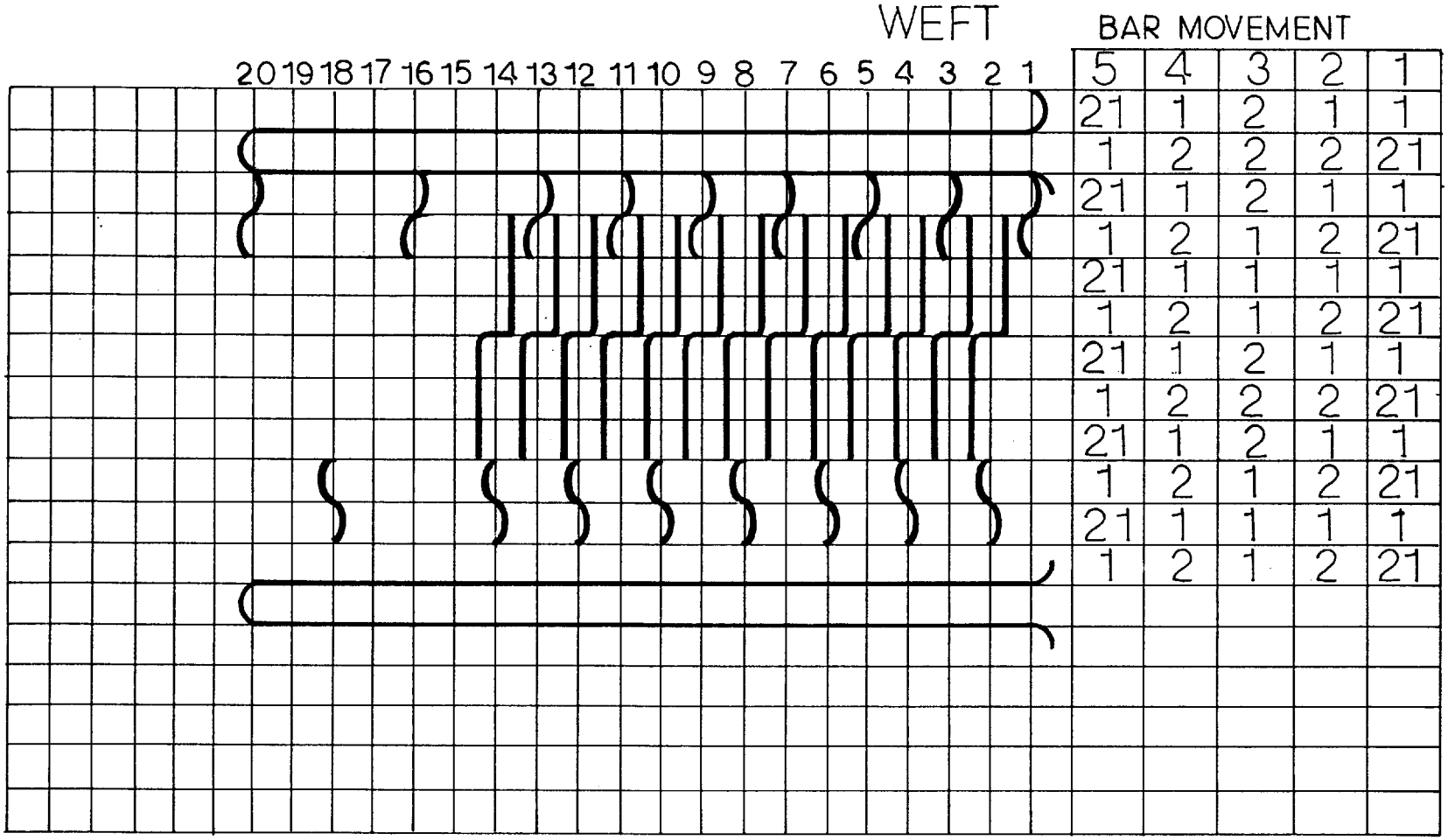
FIG. 10 is a technical drawing illustrating the construction of the third embodiment of the knitted elastic band of the present invention as made by the apparatus shown in FIG. 5.
Figure 11:
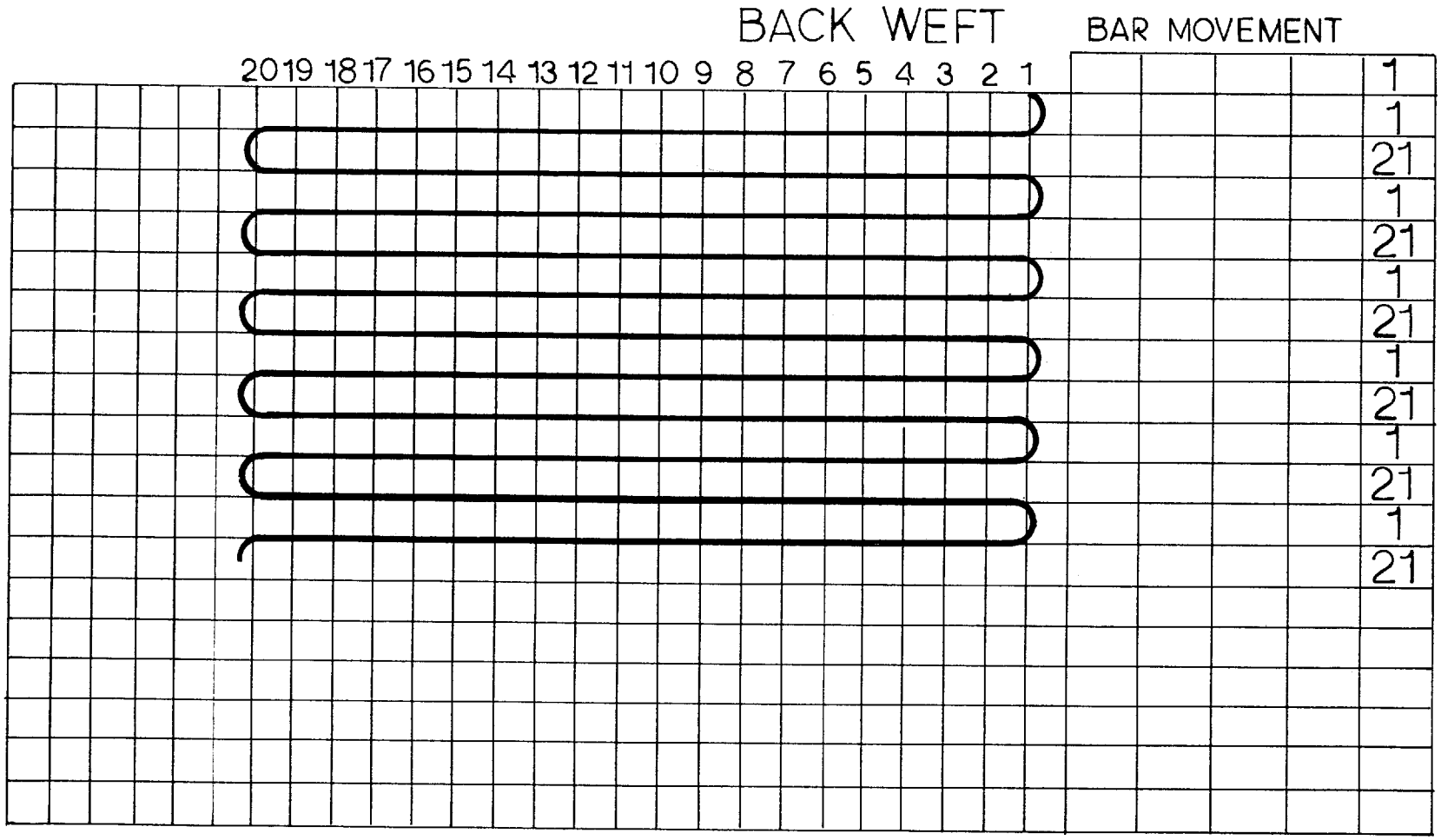
FIG. 11 is a technical drawing showing the back weft yarn of the fabric of the novel knitted elastic band shown in FIG. 10.
Figure 12:
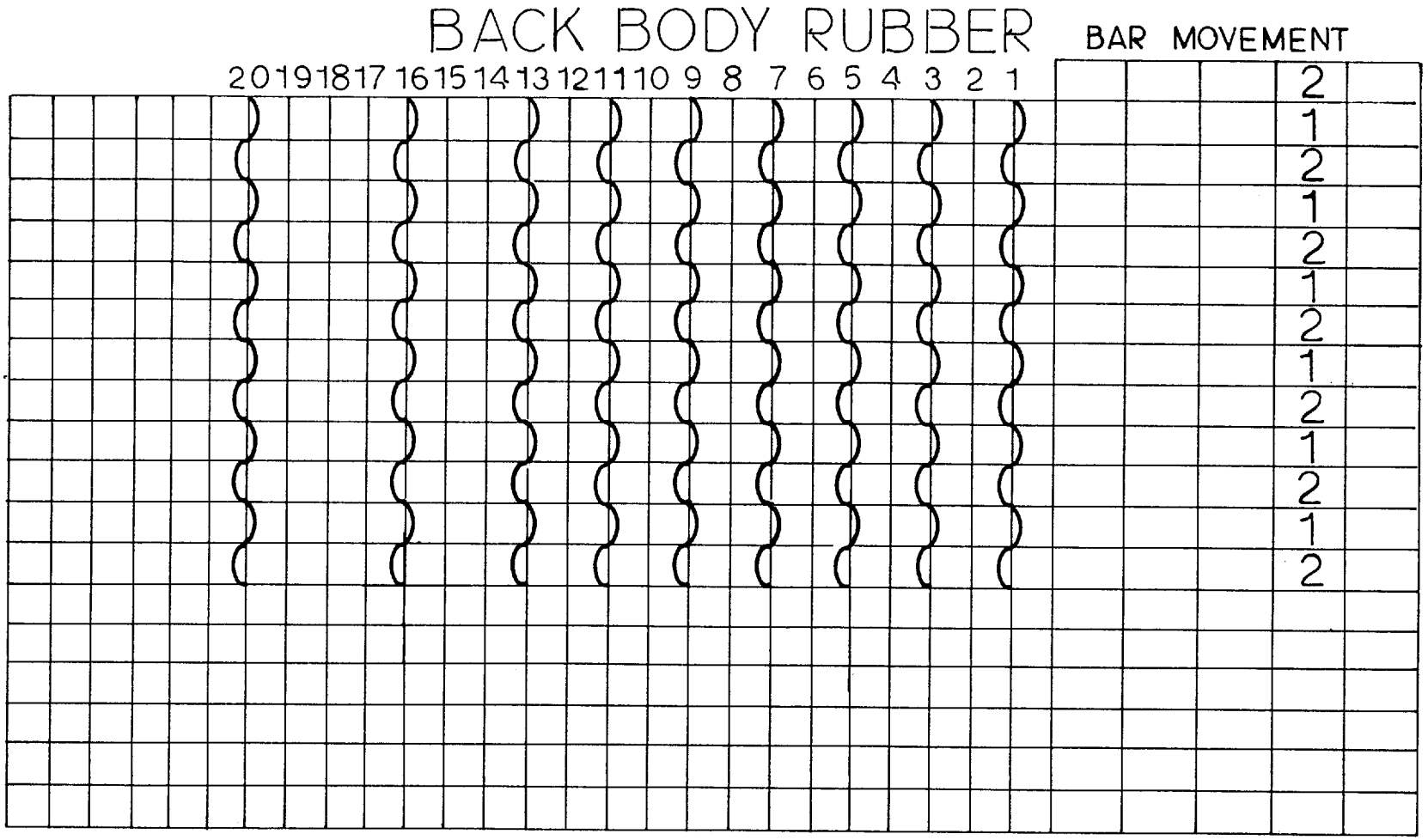
FIG. 12 is a technical drawing showing the back elastomer thread of the novel knitted elastic band shown in FIG. 10.
Figure 13:
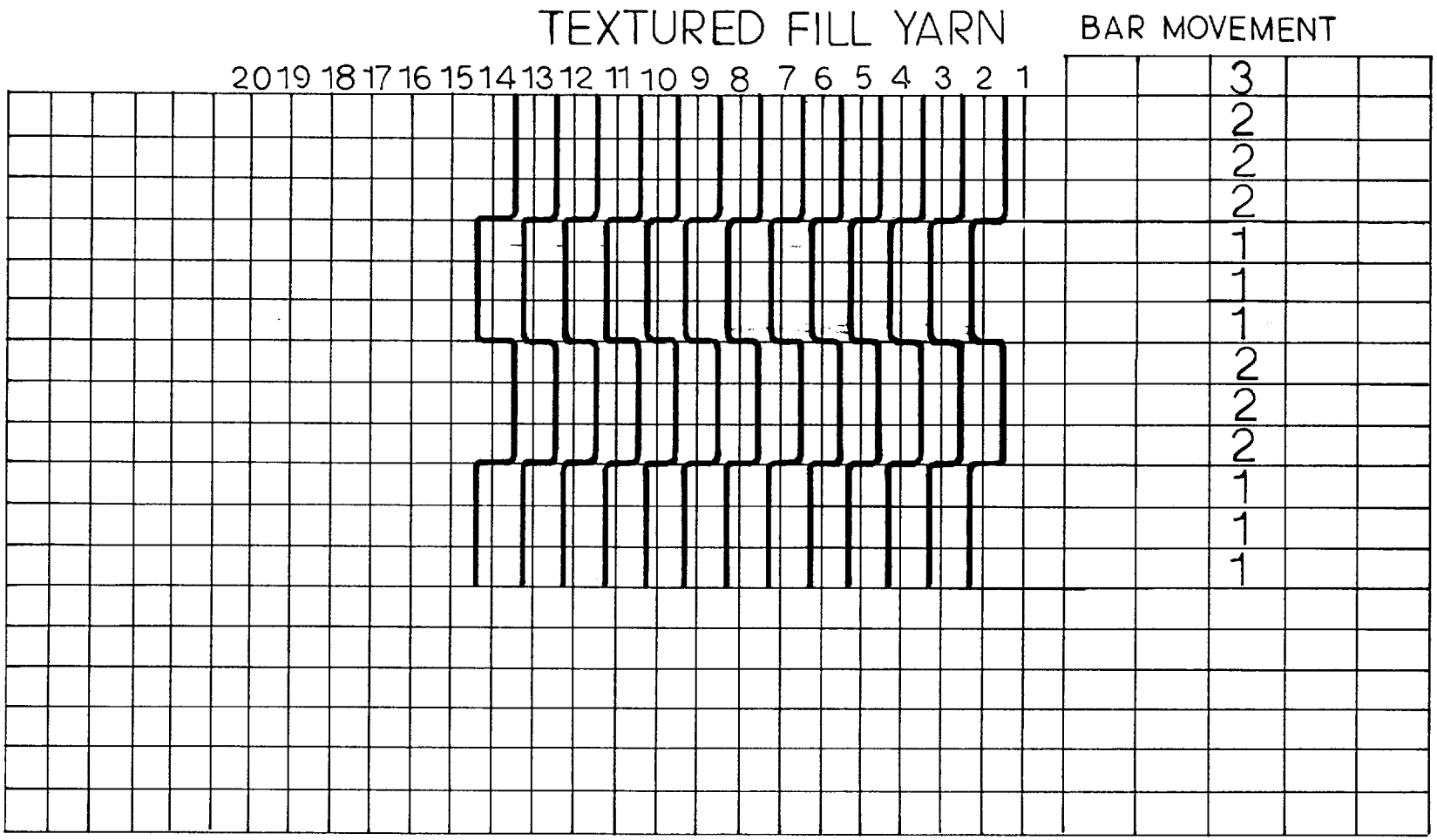
FIG. 13 is a technical drawing showing the filling yarn of the novel knitted elastic band shown in FIG. 10.
Figure 14:
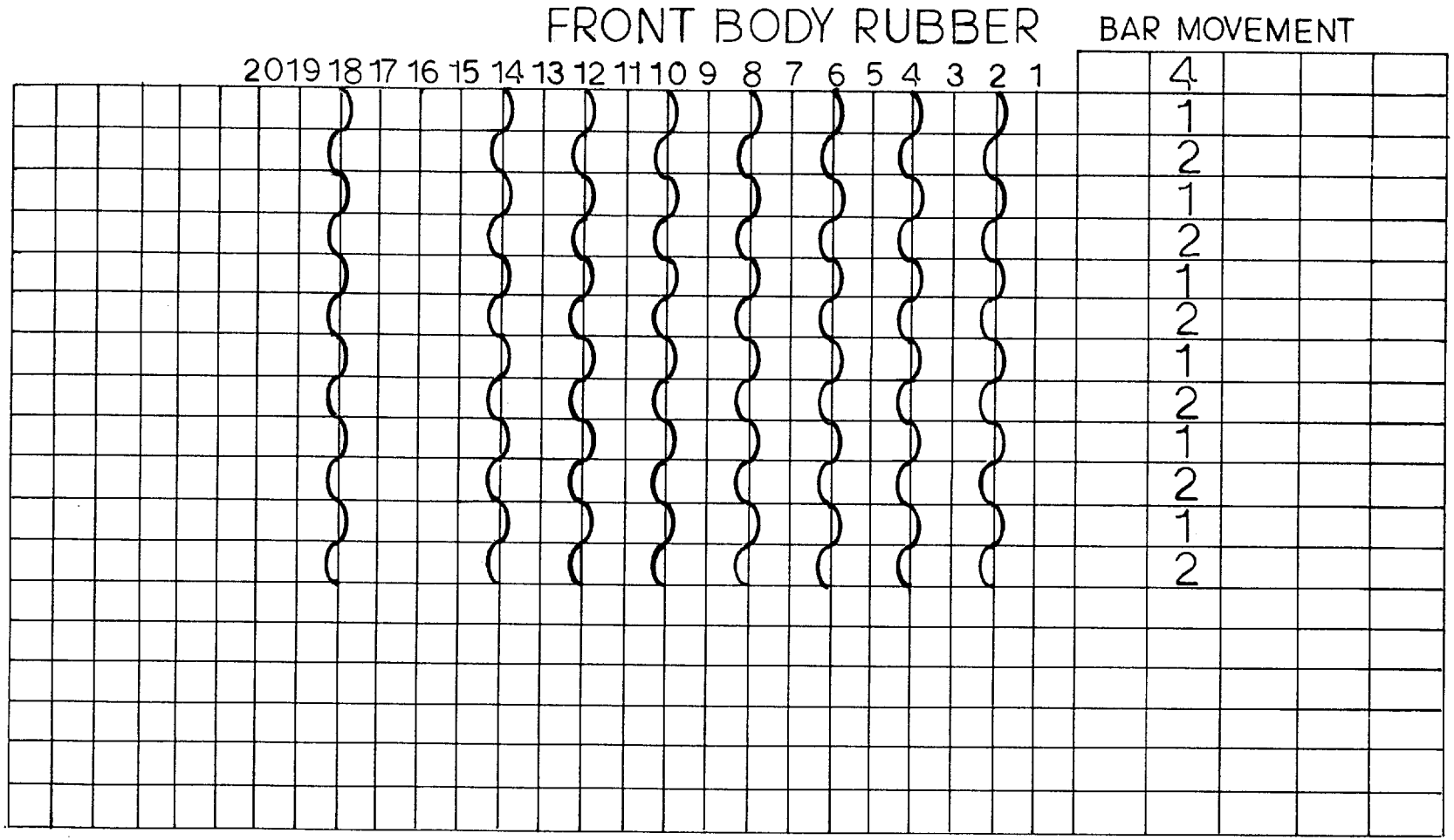
FIG. 14 is a technical drawing showing the front elastomer thread of the novel knitted elastic band shown in FIG. 10.
Figure 15:
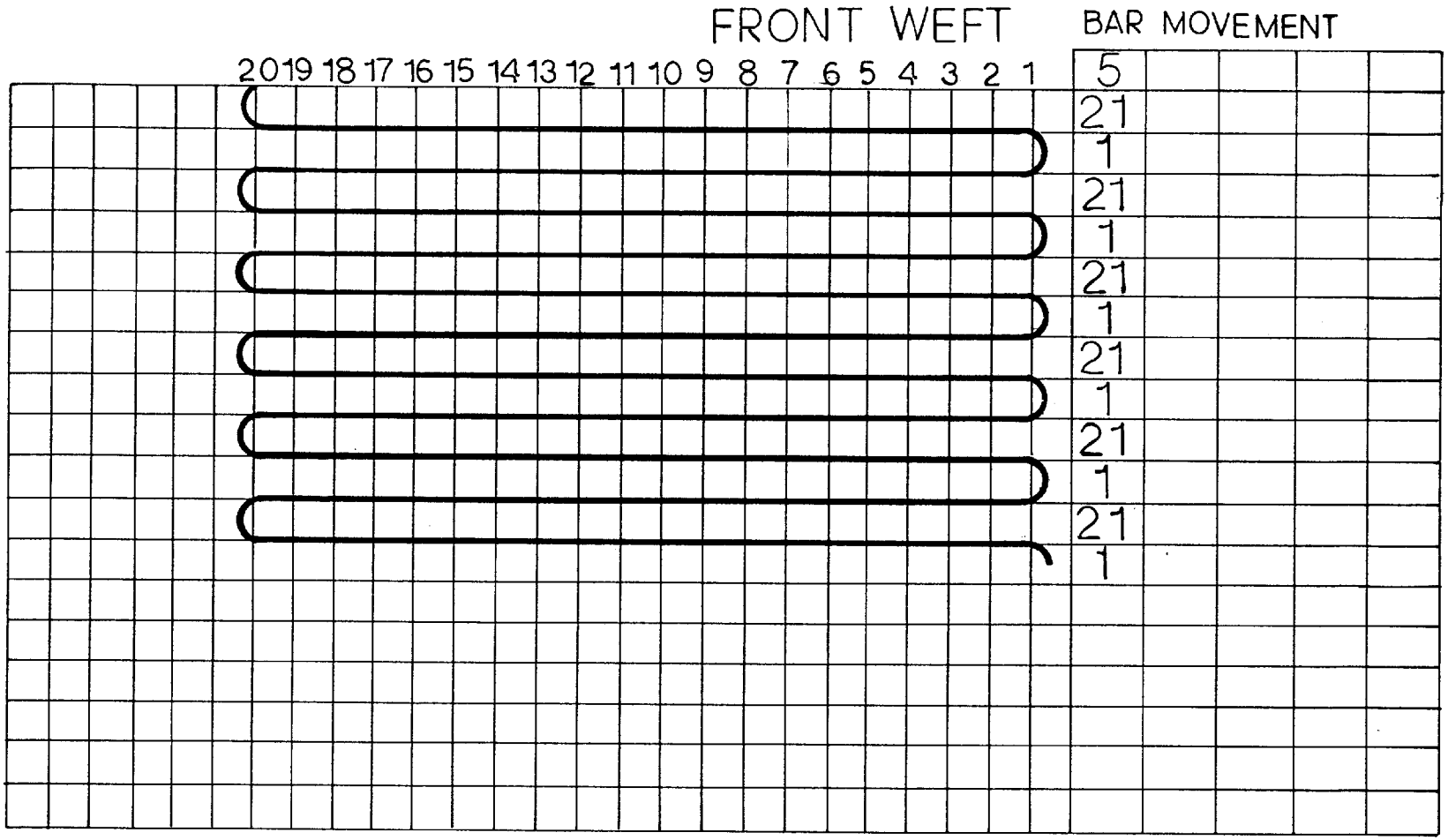
FIG. 15 is a technical drawing showing the front weft yarn of the novel knitted elastic band shown in FIG. 10.

Although applicants believe that applicants' invention can be easily understood and appreciated by one skilled in the warp knitting art with reference to the above detailed description and the appended drawings, to better appreciate applicants' novel elastic knit band 10 and the method of manufacture thereof, the construction of a representative novel elastic band 10 as shown in FIGS. 1, and 10 and produced on a COMEZ brand Model Number 814 crotchet knitting machine (although other similar machines can also be used) is set forth in Table 1 below.

TABLE 1

| FABRIC SPECIFICATIONS |
|---|
| WIDTH: 1 5/16" |
| WEIGHT PER YARD: 327 GRAINS |
| PERCENTAGES POLYESTER: >69% |
| PERCENTAGES RUBBER: >31% |
| WARP YARN IS 150 DENIER SEMI-DULL POLYESTER 17 ENDS. |
| WEFT YARN IS 150 DENIER SEMI-DULL POLYESTER 12 ENDS. |
| INTER-TEXTURE FILLING YARN IS 2-150 DENIER STRETCH POLYESTER 13 ENDS. |
| ELASTOMER THREAD IS 34 GAUGE NATURAL RUBBER THREAD. |
| OTHER VARIATIONS OF YARN, ANY COMBINATIONS OF NATURAL FIBER OR SYNTHETICS, ANY SIZE DENIER OR COUNT—DEPENDING ON DESIRED WEIGHT AND HARDNESS OF FINISHED PRODUCT CAN BE USED. |
| OTHER VARIATIONS OF AND COMBINATIONS OF NATURAL ELASTOMER OR SYNTHETIC ELASTOMER CAN BE USED—DEPENDING ON DESIRED MODULUS. |

It will be again noted that knitted elastic band 10 can be made from yarns other than those set forth above without departing from the invention. In other words, other types of yarns as well as other size yarns can be incorporated into a knit elastic band in accordance with the present invention and scope fall within the intended scope of the method and product of applicants' invention.

As also of interest, applicants would like to set forth in Table 2 hereinbelow the performance of a knit elastic band constructed in accordance with applicants' invention (see FIGS. 1 and 10) including 150 denier polyester filament warp yarn, 150 denier polyester filament weft yarn, 34 gauge natural rubber elastomer threads, and 2–150 denier stretch polyester textured filling yarn. The performance of this product with respect to strength before and after heat aging as compared to a comparable but more expensive stretch woven band is set forth below in Table 2.

TABLE 2

| | A. NOVEL KNIT BAND 1 5/16" | B. CONVENTIONAL STRETCH WOVEN BAND 1 5/16" |
|---|---|---|
| Weight Per Foot: | 109.0 Grains | 116 Grains |
| Yards Per Lb.: | 21.4 | 20.0 |
| | Strength Before Heat—Aging 2 hrs. at 300° F.: | |
| | 50% stretch-1.30 lbs | 50% stretch-1.25 lbs |
| | 70% stretch-1.60 lbs | 70% stretch-1.40 lbs |
| | 90% stretch-2.05 lbs | 90% stretch-1.75 lbs |
| | Strength After Heat—Aging 2 hrs. at 300° F.: | |
| | 50% stretch-1.05 lbs | 50% stretch-.65 lbs |
| | 70% stretch-1.30 lbs | 70% stretch-.80 lbs |
| | 90% stretch-1.65 lbs | 90% stretch-1.15 lbs |
| Retention: | 81% | 58% |
| Shrinkage: | 4% | 6% |

As can be seen, applicants' knit elastic band possesses greater strength before and after heat aging, greater strength retention and less shrinkage than the conventional stretch woven band typically utilized in applications such as men's jockey undershorts. Thus, in addition to comparable appearance and feel, applicants' novel knitted elastic band provides better strength characteristics after heat aging than does the more expensive stretch woven band.

Summarily, applicants have discovered a new stretch knit band that is formed by laying in filling yarns between the warp yarn needles and then chain stitching the filling yarns into the knit elastic band construction so as to provide enhanced appearance and hand similar to that of conventional but more expensive stretch woven bands and without the vertical ridges or horizontal "rope" ridges associated with prior art efforts to construct a knitted elastic band similar to a stretch woven band. Applicants' novel knit elastic band provides a better feel and more cover (a more refined appearance) than has heretofore been provided by knit elastic bands intended for use in men's underwear, women's lingerie, and similar garment applications.

It will be understood that various details of the invention may be changed without departing from the scope of the invention. Furthermore, the foregoing description is for the purpose of illustration only, and not for the purpose of limitation—the invention being defined by the claims.

What is claimed is:

1. A method for fabricating an elastic knit band for apparel characterized by enhanced feel and appearance relative to a conventional elastic knit band, said method comprising the steps of:

(a) providing a flat knitting weft insertion machine of the type having an elongate needle bed for carrying and initially reciprocating a plurality of warp yarn knitting needles and a warp guide bar for carrying a corresponding plurality of warp yarn guides;

(b) providing a plurality of weft insertion bars wherein each bar carries a plurality of yarn guides, said plurality of weft insertion bars comprising a back weft yarn bar and back weft yarns, at least one elastomer thread bar and elastomer threads, a filling yarn bar and textured filling yarns, and a front weft yarn bar and front weft yarns; and (c) knitting an elastic band including (1) laying the textured filling yarns in between the warp knitting needles (2) between said back and said front weft yarns and extending substantially parallel and loosely adjacent to the warp yarns for enhanced feel and appearance, and wherein said textured filling yarns do not act to limit the warp direction stretch of the knitted band.

2. A method according to claim 1 comprising providing said plurality of weft insertion bars wherein said bars comprise in sequence a back weft yarn bar and back weft yarns, a filling yarn bar and filling yarns, an elastomer thread bar and elastomer threads, and a front weft yarn bar and front weft yarns, and knitting the band by laying the filling yarns in front of said back weft yarns.

3. A method according to claim 1 comprising providing said plurality of weft insertion bars wherein said bars comprise in sequence a back weft yarn bar and back weft yarns, an elastomer thread bar and elastomer threads, a filling yarn bar and filling yarns, and a front weft yarn bar and front weft yarns, and knitting the band by laying the filling yarns behind the front weft yarns.

4. A method according to claim 1 comprising providing said plurality of weft insertion bars wherein said bars comprise in sequence a back weft yarn bar and back weft yarns, a back elastomer thread bar and back elastomer threads, a filling yarn bar and filling yarns, a front elastomer thread bar and front elastomer threads, and a front weft yarn bar and front weft yarns, and knitting the band by laying the filling yarns between the back and front elastomer threads.

5. A method according to claim 1 including providing multi-filament polyester yarns as the weft and warp yarns.

6. A method according to claim 1 including providing natural rubber thread as the elastomer thread.

7. A method according to claim 1 including providing textured yarn as the filling yarn.

8. A method according to claim 7 including providing one end of 2/150 denier textured polyester yarn as the textured filling yarn.

9. An elastic knitted band with enhanced feel and appearance produced according to the method of claim 1.

10. A method for fabricating an elastic knit band for apparel and the like characterized by enhanced feel and appearance relative to a conventional elastic knit band, said method comprising the steps of:

(a) providing a flat knitting weft insertion machine of the type having an elongate needle bed for carrying and initially reciprocating a plurality of warp yarn knitting needles and a warp guide bar for carrying a corresponding plurality of warp yarn guides;

(b) providing 5 weft insertion bars wherein each bar carries a plurality of yarn guides, said 5 weft insertion bars comprising in sequence a back weft yarn bar and back weft yarns, a back elastomer thread bar and back elastomer threads, a filling yarn bar and textured filling yarns, a front elastomer thread bar and front elastomer threads, and a front weft yarn bar and front weft yarns; and (c) knitting an elastic band including laying the textured filling yarns in between the warp knitting needles and extending substantially parallel and loosely adjacent to the warp yarns for enhanced feel and appearance wherein the textured filling yarns are positioned in the knitted band between the front and back elastomer threads and wherein said textured filling yarns do not act to limit the warp direction stretch of the knitted band.

11. A method according to claim 10 including providing multi-filament polyester yarns as the weft and warp yarns.

12. A method according to claim 10 including providing natural rubber thread as the elastomer thread.

13. A method according to claim 10 including providing textured yarn as the filling yarn.

14. A method according to claim 13 including providing one strand of 2/150 denier textured polyester yarn as the textured filling yarn.

15. An elastic knitted band with enhanced feel and appearance produced according to the method of claim 10.

16. A method for fabricating an elastic knit band for apparel and the like characterized by enhanced feel and appearance relative to a conventional elastic knit band, said method comprising the steps of:

(a) providing a flat knitting weft insertion machine of the type having an elongate needle bed for carrying and initially reciprocating a plurality of warp yarn knitting needles and a warp guide bar for carrying a corresponding plurality of warp yarn guides;

(b) providing 5 weft insertion bars wherein each bar carries a plurality of yarn guides, said 5 weft insertion bars comprising in sequence a back weft yarn bar and back weft yarns, a back elastomer thread bar and back elastomer threads, a filling yarn bar and filling yarns, a front elastomer thread bar and front elastomer threads, and a front weft yarn bar and front weft yarns; and (c) knitting an elastic band including laying filling yarn in between the warp knitting needles for enhanced feel and appearance wherein the filling yarn is positioned in the knitted band between the front and back elastomer threads, said band comprising:

(i) back weft yarn laid sequentially across 20 needles beginning at needle 1;

(ii) back elastomer thread knitted on every other needle beginning at needle 1 of 20;

(iii) knitted filling yarn in every third movement on needles 2–14;

(iv) front elastomer thread knitted on every other needle starting at needle 2 of 20; and (v) front weft yarn laid sequentially across 20 needles beginning at needle 20 and ending at needle 1.

* * * * *